US005647739A

United States Patent [19]

McDonald

[11] Patent Number: 5,647,739

[45] Date of Patent: Jul. 15, 1997

[54] NOZZLE FOR USE IN A BURNER

[75] Inventor: Douglas B. McDonald, Rockford, Ill.

[73] Assignee: Eclipse, Inc., Rockford, Ill.

[21] Appl. No.: 419,406

[22] Filed: Apr. 10, 1995

[51] Int. Cl.[6] ..... F02C 7/00

[52] U.S. Cl. ..... 431/352; 431/353; 431/10

[58] Field of Search ..... 431/263, 9, 10, 431/350, 353, 532, 351; 60/732

[56] References Cited

U.S. PATENT DOCUMENTS

| | | | |
|---|---|---|---|
| 3,220,460 | 11/1965 | Goubsky et al. | 431/353 |
| 3,490,230 | 1/1970 | Pillsbury et al. | 431/352 |
| 3,531,230 | 9/1970 | Apolinarski | 431/352 |
| 3,736,747 | 6/1973 | Warren | 60/732 |
| 4,041,699 | 8/1977 | Schelp | 60/732 |
| 4,265,615 | 5/1981 | Lohmann et al. | 431/353 |
| 4,382,771 | 5/1983 | Carr | 431/10 |
| 4,927,349 | 5/1990 | Schirmer et al. | 431/10 |
| 5,002,483 | 3/1991 | Becker | 431/10 |
| 5,263,849 | 11/1993 | Irwin et al. | 431/6 |
| 5,460,515 | 10/1995 | Harbeck et al. | 431/263 |

FOREIGN PATENT DOCUMENTS

| | | | |
|---|---|---|---|
| 287783 | 11/1966 | Australia | 431/352 |
| 2272338 | 12/1975 | France | 431/352 |
| 1451461 | 7/1969 | Germany | 431/352 |
| 2937631 | 4/1981 | Germany | 431/352 |
| 0705211 | 1/1980 | U.S.S.R. | 431/353 |

OTHER PUBLICATIONS

Eclipse Combustion, inc. Spec 210– Apr. 1990.

North American Mfg. Co., Specification 4442– Jun. 1993.

SVG Super Velocity Gas Burner Series– Mar. 1991.

*Primary Examiner*—Carl D. Price

*Attorney, Agent, or Firm*—Leydig, Voit & Mayer, LTD.

[57] ABSTRACT

A nozzle adapted for use in a high excess air burner. The nozzle includes three combustion chambers and an outer flame retention ring for supporting combustion of gaseous fuel over a range of volumetric flow rates. Combustion air is staged to each of the combustion chambers and to the outer flame retention ring for mixing with the fuel to form a combustible fuel-air mixture. Combustion occurs in the first combustion chamber at relatively low flow rates of fuel. Combustion occurs in the second and third combustion chambers and the outer flame retention ring with increasingly higher fuel flow rates. The second combustion chamber is configured with a radially inwardly converging sidewall to provide for a smooth transition of the flame between the second and third combustion chambers.

13 Claims, 1 Drawing Sheet

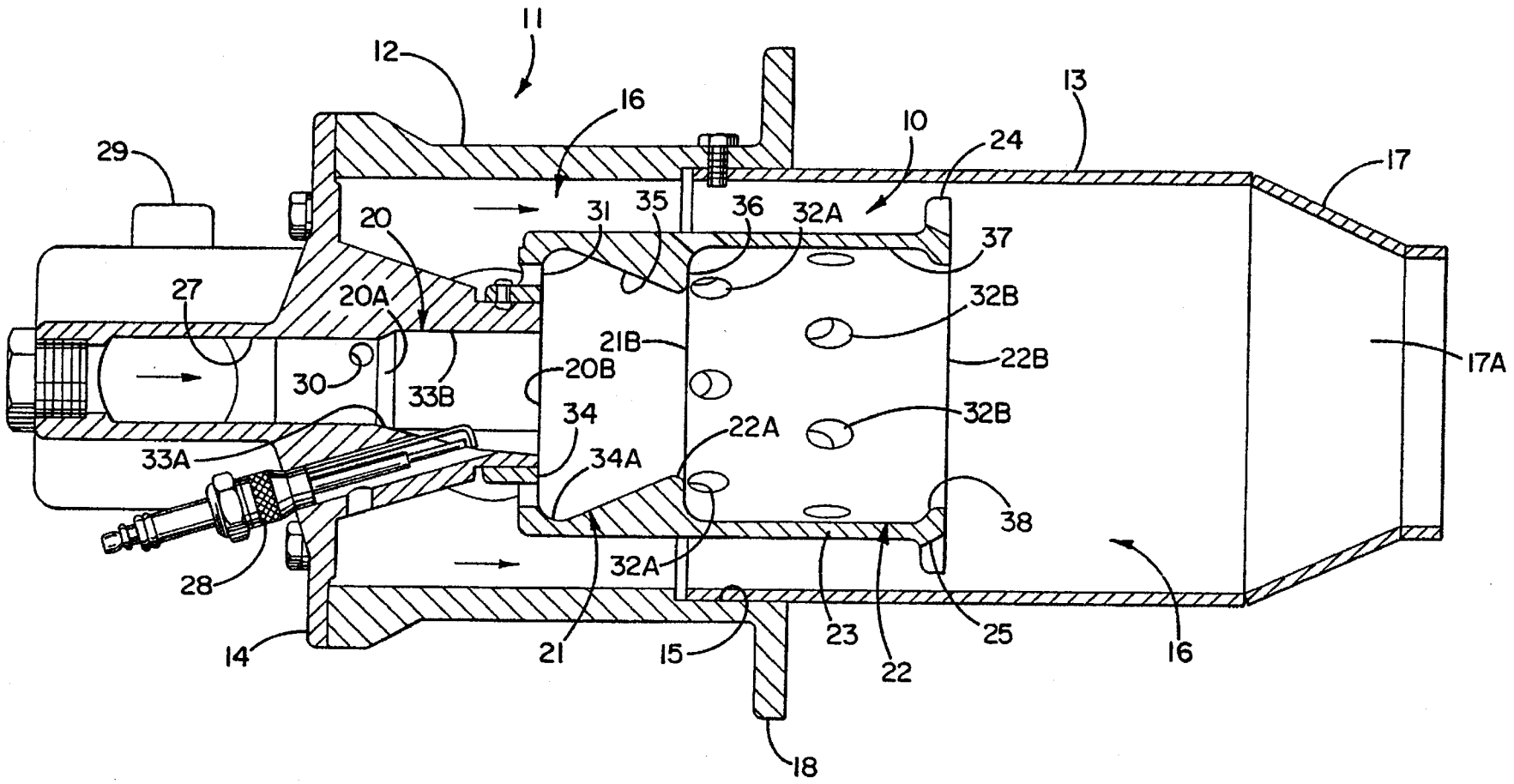
17A
17
16
13
24
37
32B
22B
32B
38
25
10
22
23
32A
36
22A
18
15
35
21B
32A
16
31
20B
34
34A
21
11
12
33B
20
20A
30
14
28
27
33A
29

NOZZLE FOR USE IN A BURNER

BACKGROUND OF THE INVENTION

This invention relates generally to a nozzle for use in a gas burner and more specifically to a nozzle which is particularly suitable for use in a high excess air burner that operates over a relatively wide range of fuel flow rates.

A nozzle of this general type is constructed with multiple combustion chambers. Each combustion chamber has an inlet opening for receiving the fuel-air mixture from the previous or upstream chamber and typically has additional passages for receiving additional combustion air. Combustion air is staged through the axially spaced passages to allow the nozzle to operate over the range of fuel flow rates. For example, as the flow of fuel increases and the fuel-air mixture becomes fuel rich in one combustion chamber, the flame front moves forwardly or downstream into the next combustion chamber where additional air is delivered to the flame through additional openings. The additional air brings the volumetric fuel-to-air ratio of the mixture in the downstream combustion chamber to within the flammability limits of the fuel. Alternately, as the flow of fuel decreases and the fuel-air mixture becomes fuel lean in one combustion chamber, the flame front moves upstream into the previous combustion chamber where one less set of openings delivers air to the mixture. In a similar manner, if the flow of air delivered to the flame increases to a point where the fuel-air mixture becomes fuel lean in one combustion chamber, the flame front transitions upstream into the previous combustion chamber. During normal operation of a high excess air burner, the flame front transitions throughout the nozzle as the volumetric flow rate of either the air or the fuel varies within the predefined operating limits of the burner.

To provide for stable flame retention in each combustion chamber, the combustion chamber is constructed so that the fuel-air mixture expands as it enters that combustion chamber. The relatively high velocity of the fuel-air mixture at the inlet opening, as compared to the velocity of the expanded fuel in the upstream end of the chamber, prevents the flame from flashing back toward the source of the fuel.

Successful operation of a nozzle having more than one combustion chamber requires that the flame smoothly transition between adjacent combustion chambers. In the absence of provisions for a smooth flame transition, there tends to be a region of unstable operation where the flame is unable to establish itself in either of the adjacent combustion chambers. This instability is substantially due to the turbulent nature of the fuel-air mixture as it flows through the inlet opening of the downstream combustion chamber and tends to cause the flame front to jump back and forth between the two adjacent combustion chambers. Under extremely turbulent conditions at high flow rates, this instability may cause the flame to be extinguished.

If the upstream chamber is operating at a relatively low fuel flow rate, a smooth flame transition may be provided by causing the fuel-air mixture in the upstream chamber to swirl as it exits that chamber and enters the next chamber. However, if the fuel flow rate is relatively high, a swirling fuel-air mixture detrimentally affects the operating efficiency of the nozzle.

SUMMARY OF THE INVENTION

The general aim of the present invention is to provide a new and improved nozzle for use in a high excess air burner where the nozzle is capable of stable operation over a wide range of volumetric fuel flow rates.

A more detailed objective is to achieve the foregoing by providing a nozzle in which a flame is capable of smoothly transitioning between adjacent combustion chambers while operating with relatively high fuel flow rates.

A still more detailed objective of the invention is to provide an upstream combustion chamber having sidewalls which converge radially inwardly upon progressing toward the downstream end of the combustion chamber so that the velocity profile of the fuel-air mixture at the exit end of the combustion chamber is relatively constant.

Another more detailed objective is to provide a downstream combustion chamber where the velocity profile of the fuel-air mixture entering the upstream end of the combustion chamber through an inlet opening is relatively constant.

These and other objects and advantages of the invention will become more apparent from the following detailed description when taken in conjunction with the accompanying drawings.

BRIEF DESCRIPTION OF THE DRAWINGS

The single FIGURE of the drawing is a schematic representation of a typical high excess air burner with a new and improved nozzle incorporating the unique features of the present invention.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

For purposes of illustration, the present invention is shown in the drawings as embodied in a nozzle 10 which is adapted for use in a high excess air burner 11. High excess air burners are useful in applications where it is desirable to have a high velocity discharge from the burner. For example, in a high temperature furnace where the high temperature discharge from the burner is to be mixed with additional air in a chamber downstream of the burner and where a mixing fan is not available, the high velocity of the discharge from the burner provides turbulent means for mixing the high temperature discharge with the additional air. For this purpose, excess air, i.e., air in excess of the air that is necessary for combustion of the fuel, flows around the nozzle and discharges through the exit of the burner.

The burner 11 includes a generally cylindrical body or burner housing 12, a cylindrical combustion tube 13 which is secured to the downstream end of the burner housing, and a backplate 14 which is secured to the upstream end of the burner housing and which closes off the upstream end of the burner from the outside environment. The burner housing and the upstream end portion of the combustion tube are formed with cylindrical interior surfaces having the same diameter. The upstream end portion of the combustion tube is secured in a recess 15 formed in the downstream end portion of the burner housing so that the interior surface of the combustion tube extends forwardly from the downstream end of the interior surface of the burner housing to define a generally cylindrical air chamber 16. The downstream end portion of the combustion tube is formed with a radially inwardly converging internal surface which defines a converging burner exit 17. A radially outwardly projecting mounting flange 18 is formed integrally with the downstream end of the burner housing for mounting the burner to the furnace.

The nozzle 10 is located in the air chamber 16 and, for purposes of illustration, includes three coaxial combustion chambers 20, 21 and 22. The first combustion chamber 20 is defined in a forwardly projecting portion of the backplate 14. The second and third combustion chambers, 21 and 22 respectively, are defined in a nozzle housing 23 which is secured to the forwardly projecting portion of the backplate. A radially outwardly extending flame retention ring 24 is integrally formed at the downstream end of the nozzle housing. Axially and radially inwardly extending slots 25 are formed in the outer flame retention ring and are circumferentially spaced around the flame retention ring. The base of each slot defines a surface which slopes radially inwardly upon progressing toward the burner exit 17.

Gaseous fuel is supplied to the upstream or inlet end of the first combustion chamber 20 through an inlet tube 27 formed in the backplate 14. The fuel flows forwardly in the nozzle 10 where combustion air is mixed with the fuel to form a combustible fuel-air mixture. A spark plug 28 is threaded into the backplate so that the spark plug electrode extends into a slot formed in the first combustion chamber for ignition of the combustible mixture. Adjustable means (not shown) control the volumetric flow rate of the fuel entering the nozzle.

Gas is supplied to the burner 11 through a fitting or port 29 located in the backplate 14. The air enters the upstream end of the air chamber 16 through internal passages (not shown) in the backplate and flows forwardly in the air chamber and along the length of the nozzle housing 23 toward the converging exit 17 of the burner. A relatively small percentage of the air enters the nozzle 10 from the air chamber through passages 30, 31, 32A and 32B for mixing with the flow of fuel in the nozzle. The velocity of the remaining excess air increases as it flows through the converging exit of the burner, resulting in the desired high velocity discharge from the burner. Adjustable means (not shown) control the volumetric flow rate of the air entering the burner.

The passage 30 is formed in the sidewall of the forwardly projecting portion of the backplate 14 and communicates with the air chamber 16 to supply combustion air to be mixed with the fuel in the inlet tube 27—directly upstream of the first combustion chamber 20. The centerline of the passage 30 is generally perpendicular to and lies in a plane which is displaced outwardly from the longitudinal centerline of the inlet tube so that the combustion air entering the inlet tube has a tangential velocity component with respect to the flow of fuel in the inlet tube. The tangential velocity component of the combustion air entering the inlet tube results in a swirling fuel-air mixture at the inlet of the first combustion chamber.

The upstream end of the first combustion chamber 20 is formed with a gradually increasing cross-sectional flow area defined by an outwardly expanding frustoconically-shaped interior surface or sidewall 33A extending from the inlet end 20A. The remainder of the first combustion chamber is formed with a generally cylindrical interior surface 33B extending from the downstream end of the frustoconical surface 33A. This construction insures that the forward velocity of the fuel-air mixture in the first combustion chamber is greatest at the inlet of that chamber in order to prevent the flame from flashing back into the inlet tube and to insure that the swirling of the mixture is not interrupted in the first combustion chamber.

The second combustion chamber 21 is formed with a backwall 34 and an interior surface or sidewall 35 having a circular cross-section. The second combustion chamber is located adjacent and downstream of the first combustion chamber 20 so that the downstream or exit 20B of the first combustion chamber defines an inlet opening to the second combustion chamber, the inlet opening being located in the backwall 34. The cross-sectional flow area at the upstream end of the second combustion chamber, as defined by the interior surface 35 at the backwall 34, is substantially greater than the cross-sectional flow area at the inlet opening of the second combustion chamber. As a result of this abrupt increase in flow area, the fuel-air mixture expands and its forward velocity substantially decreases as the mixture enters the second combustion chamber, thereby providing for flame retention at the inlet opening of the second combustion chamber. The passages 31 extend from the air chamber 16 through the backwall 34 and are located radially outwardly from the inlet opening. The air flowing through the passages 31 enters the upstream end of the second combustion chamber in a generally axial direction and mixes with the expanding fuel-air mixture.

The third combustion chamber 22 is formed with a backwall 36 and a cylindrical interior surface or sidewall 37. The third combustion chamber is located adjacent and downstream of the second combustion chamber 21 so that the exit end of the second combustion chamber defines an inlet opening to the third combustion chamber, the inlet opening being located in the backwall 36. The cross-sectional flow area at the upstream end of the third combustion chamber, as defined by the interior surface 37, is substantially greater than the cross-sectional flow area at the inlet opening of the third combustion chamber. As a result of this abrupt increase in flow area, the fuel-air mixture expands and its forward velocity decreases substantially as the mixture enters the third combustion chamber, thereby providing for flame retention at the inlet opening to the third combustion chamber. The passages 32A, 32B extend from the air chamber 16 radially inwardly through the sidewall 37. Air flows through the passages 32A, 32B for mixing with the fuel-air mixture in the third combustion chamber.

Combustion air is supplied to each of the combustion chambers 20, 21 and 22 and to the outer flame retention ring 24 to accommodate the flammability limits of the fuel. If the flame is located in an upstream chamber, for example the second combustion chamber 21, and the volumetric flow rate of the fuel increases to the point where the fuel-air mixture in the second combustion chamber becomes fuel rich, i.e., the volumetric fuel-to-air ratio exceeds the maximum flammability limit of the fuel, the flame front transitions into the downstream or third chamber 22 where additional air is supplied to the mixture through passages 32A, 32B. The additional air brings the fuel-to-air mixture ratio in the third combustion chamber to within the flammability limits of the fuel. Alternatively, if the flame front is in the third combustion chamber and the volumetric flow rate of the fuel is decreased to the point where the fuel-air mixture in the third combustion chamber becomes fuel lean, the flame transitions upstream to the second combustion chamber where the passages 32A, 32B are no longer delivering air to the mixture at the flame. In a similar manner, if the flow of air delivered to the flame in the third combustion chamber increases to a point where the fuel-air mixture becomes fuel lean, the flame transitions upstream into the second combustion chamber.

The nozzle 10 is designed to support combustion, i.e., to retain a flame, in each of the combustion chambers 20, 21 and 22 and at the outer flame retention ring 24. If the volumetric flow rate of the fuel being supplied to the nozzle is at a predetermined minimum operating condition, a stable flame front will establish itself near the upstream end of the first combustion chamber 20. Alternately, if the volumetric flow rate of the fuel being supplied to the nozzle is at a predetermined maximum for a given volumetric flow rate of air (a so-called high-fire condition), the flame front will be located on the outer flame retention ring 24. A radially inwardly extending restriction 38 is integrally formed at the exit end of the third combustion chamber 22 to enhance stability of the flame when the flame is located on the outer flame retention ring. For a given flow rate of air, the second and third combustion chambers support combustion of the fuel as the flow rate varies between the predetermined minimum and maximum.

Successful operation of the nozzle 10 requires that the flame smoothly transition between the combustion chambers 20, 21 and 22 as the flow rate of the fuel varies. In the absence of provisions for a smooth flame transition, there tends to be a region of unstable operation where the flame is unable to establish itself in either of two adjacent combustion chambers. This instability is substantially due to the turbulent nature of the fuel-air mixture as it flows through the inlet opening of the downstream combustion chamber and tends to cause the flame front to jump back and forth between the two adjacent combustion chambers. Under extremely turbulent conditions at high flow rates, this instability may cause the flame to be extinguished.

The flame transitions smoothly between the first combustion chamber 20 and the second combustion chamber 21 by virtue of the swirling fuel-air mixture at the exit end of the first combustion chamber. Since the flow rate of the fuel-air mixture in the first combustion chamber is relatively low, this swirling mixture has negligible effect on the efficiency of the nozzle. However, the flow rate of the fuel-air mixture is relatively high when the flame front is located in the second combustion chamber. If a swirling mixture were provided at the exit of the second combustion chamber, the swirling mixture would detrimentally affect the efficiency of the nozzle.

In accordance with the present invention, the second combustion chamber 21 is uniquely configured so that the flow area in the second combustion chamber smoothly decreases upon progressing toward the exit end of the second combustion chamber. As a result, the base of the flame smoothly transitions between the second combustion chamber and the third combustion chamber 22 as the volumetric flow rate of the fuel varies between the operating ranges of the second and third combustion chambers.

More specifically, the sidewall 35 of the second combustion chamber 21 defines a frustoconical chamber which converges radially inwardly upon progressing forwardly or downstream from the backwall 34 toward the exit end of the second combustion chamber. The outer periphery of the backwall 34 is preferably formed with an internal radius 34A so that the backwall smoothly merges with the sidewall 35. The exit end of the second combustion chamber also is preferably formed with an external radius 22A so that the sidewall 35 smoothly merges with the inlet opening of the third combustion chamber 22.

Substantial turbulence is created in the fuel-air mixture as the mixture expands at the upstream end of the second combustion chamber 21. This turbulence enables the combustion air entering the second combustion chamber through the passages 31 to mix thoroughly with the fuel-air mixture flowing from the first combustion chamber 20. The smoothly and gradually decreasing flow area of the second combustion chamber as defined by the sidewall 35, causes the velocity of the fuel-air mixture in the second combustion chamber to increase at a relatively constant rate as the mixture flows toward the exit end of the second combustion chamber. As a result, the velocity profile of the fuel-air mixture at the exit end of second combustion chamber is relatively constant so as to enable the base of the flame to smoothly transition between the second combustion chamber and the third combustion chamber 22.

With the foregoing, the present invention brings to the art a new and improved nozzle 10 which uniquely provides for a smoothly converging flow area in an upstream combustion chamber, i.e., the second combustion chamber 21, which is capable of operating with relatively high fuel flow rates. The smoothly converging flow area provides for a smooth flame transition between the upstream combustion chamber and an adjacent downstream combustion chamber, i.e., the third combustion chamber 22. Accordingly, the nozzle is capable of stable operation over a wide range of relatively high fuel flow rates.

I claim:

1. A high excess air burner comprising a generally tubular body having a downstream end portion and a substantially closed upstream end portion and having an inner surface defining a generally cylindrical air chamber along the major length of said body, said inner surface converging radially inwardly at said downstream end portion to define a converging exit opening, a nozzle located in said air chamber and spaced radially inwardly of said inner surface, said nozzle having an upstream end portion secured to said upstream end portion of said body and having an open downstream end portion located in said air chamber, a fuel inlet adapted to supply a variable volumetric flow rate of fuel to said upstream end of said nozzle, an air inlet adapted to supply air to the air chamber for flow generally axially from said upstream end of said body toward said converging exit opening and axially along said nozzle, first, second and third combustion chambers defined in said nozzle, said first combustion chamber having an inlet opening communicating with said fuel inlet for receiving the variable volumetric flow rate of fuel, the first combustion chamber having a generally cylindrical outer wall having combustion air inlets formed therein communicating with the air chamber so that said fuel is mixed with a first portion of said combustion air to form a first fuel air mixture in the first combustion chamber, said second chamber having a backwall and an exit end and having a sidewall of circular cross-section, said sidewall converging radially inwardly upon progressing toward said exit end, said backwall having an inlet opening communicating with said first combustion chamber for receiving said first mixture and having a plurality of openings communicating with said air chamber for receiving a second portion of said combustion air whereby said second portion of said combustion air is capable of mixing with said first mixture in said second combustion chamber to form a second fuel-air mixture, said third combustion chamber having an inlet opening communicating with said exit end of said second combustion chamber for receiving said second mixture and having a plurality of openings communicating with said air chamber for receiving a third portion of said combustion air wherein said third portion of said combustion air is capable of mixing with said second mixture in said third combustion chamber to form a third fuel-air mixture, each of said combustion chambers being capable of supporting combustion of the respective fuel-air mixtures therein, the combustion flame transitioning between said combustion chambers as the volumetric flow rate of said fuel is varied, the flame generally transitioning from said first combustion chamber through said second combustion chamber and to said third combustion chamber as the volumetric flow rate of the fuel is progressively increased.

2. A burner as recited in claim 1 in which the air inlets in the first combustion chamber are positioned so that said first portion of said combustion air enters said combustion chamber having a tangential velocity component whereby said first portion of said combustion air imparts a rotational motion to said first fuel-air mixture.

3. A burner as recited in claim 1 in which said sidewall of said second combustion chamber is generally frustoconically-shaped.

4. A burner as recited in claim 1 in which said burner further comprises an integrally formed ring extending radially outwardly from said downstream end of said nozzle and into said air chamber, said ring having circumferentially spaced slots extending axially through said ring so that a fourth portion of said air flows through said slots and is capable of mixing with said third mixture as said third mixture exits said downstream end of said nozzle whereby said ring acts as a means for retaining a flame, the combustion flame transitioning from said first combustion chamber through said second and third combustion chambers to said ring as the volumetric flow rate of the fuel is progressively increased.

5. A burner as recited in claim 4 in which said slots extend radially inwardly from the circumference of said ring.

6. A burner as recited in claim 5 in which a surface is defined at the root of said slot, each surface being angled radially inwardly upon progressing toward said exit end.

7. A nozzle for use in a high excess air burner, said burner having a fuel input adapted to supply a variable volumetric flow rate of fuel to said nozzle the burner also having an air chamber supplied with air parts of which is for combustion in said nozzle and the remainder is for passage to an outlet of said burner, said nozzle comprising first, second and third combustion chambers generally aligned along an axis extending from an upstream to a downstream end, said first combustion chamber being generally cylindrical in shape and having an inlet opening communicating with the fuel input for receiving the variable volumetric flow rate of fuel and having an outlet, the first combustion chamber also having a plurality of openings about the cylindrical periphery thereof for admitting a first portion of said combustion air to provide a first fuel-air mixture for combustion in the first combustion chamber, means for igniting the fuel air mixture in the first combustion chamber, said second combustion chamber having an upstream backwall and a downstream exit and, said second combustion chamber having a sidewall of circular cross-section and having a plurality of openings in the backwall communicating with said air chamber for receiving a second portion of said combustion air, said sidewall extending between said backwall and said exit end and smoothly converging in cross-sectional flow area upon progressing from said backwall toward said exit end, said backwall having an inlet opening communicating with the outlet of said first combustion chamber for mixing the second portion of said combustion air with the fuel-air mixture from the outlet of the first combustion chamber, said third combustion chamber having an inlet opening communicating with said exit end of the said second combustion chamber for receiving the fuel-air mixture from the second combustion chamber, the third combustion chamber being generally cylindrical and having a plurality of air openings in the periphery thereof communicating with the air chamber for receiving a third portion of said combustion air, each of said combustion chambers being capable of supporting combustion of said fuel whereby the combustion flame transitions between said combustion chambers as the volumetric flow rate of fuel varies, the flame generally transitioning from said first combustion through said second combustion chamber and to said third combustion chamber as the volumetric flow rate of the fuel is progressively increased.

8. A nozzle as recited in claim 7 in which the air openings in the periphery of the first combustion chamber are positioned so that said first portion of said combustion air enters said first combustion chamber with a tangential velocity component whereby said first portion of said combustion air imparts a rotational motion to said first fuel-air mixture.

9. A nozzle as recited in claim 7 in which said sidewall of said second combustion chamber is generally frustoconically-shaped.

10. A nozzle as recited in claim 7 in which the outer periphery of said backwall is formed with an internal radius for smoothly merging into said sidewall of said second combustion chamber, and in which said inlet opening of said third combustion chamber is formed with an external radius for smoothly merging away from said sidewall of said second combustion chamber.

11. A nozzle as recited in claim 7 in which said plurality of openings in said second combustion chamber are form in said backwall.

12. A nozzle as recited in claim 7 in which said third combustion chamber further includes a sidewall with openings which define said plurality of openings in said third chamber.

13. A nozzle as recited in claim 12 in which said sidewall of said third combustion chamber is cylindrically-shaped.

* * * * *